US005374150A

United States Patent [19]

Becker et al.

[11] Patent Number: 5,374,150

[45] Date of Patent: Dec. 20, 1994

[54] MULTI-TIER PARKING FACILITY SYSTEM FOR DEPOSITING AND REMOVING VEHICLES

[75] Inventors: Klaus Becker; Rüdiger Ostholt, both of Wetter, Germany

[73] Assignee: Mannesmann Aktiegensellschaft, Dusseldorf, Germany

[21] Appl. No.: 52,247

[22] Filed: Apr. 22, 1993

[30] Foreign Application Priority Data

Apr. 24, 1992 [DE] Germany ..... 4214632

[51] Int. Cl.[5] ..... E04H 6/22; B65G 1/04; B66F 7/00

[52] U.S. Cl. ..... 414/254; 414/280

[58] Field of Search ..... 414/253, 254, 255, 256, 414/262, 264, 277, 280, 234, 267

[56] References Cited

U.S. PATENT DOCUMENTS

| | | | |
|---|---|---|---|
| 2,598,413 | 5/1952 | Morley | 414/254 X |
| 3,675,799 | 7/1972 | Steed et al. | 414/264 X |
| 3,896,955 | 7/1975 | Collins et al. | 414/254 |
| 4,265,581 | 5/1981 | Ives et al. | 414/254 X |
| 4,793,760 | 12/1988 | Valli | 414/254 |
| 4,950,117 | 8/1990 | Go | 414/254 |
| 5,018,926 | 5/1991 | Sternad | 414/234 X |

*Primary Examiner*—Michael S. Huppert
*Assistant Examiner*—James Eller
*Attorney, Agent, or Firm*—Cohen, Pontani, Lieberman, Pavane

[57] ABSTRACT

The invention is directed to a multi-tier parking facility system for depositing and removing vehicles, particularly passenger automobiles. The facility includes parking devices which are arranged in a plurality of levels in corresponding parking spaces. Each parking device has plural comb-like carrying arms for receiving the vehicles. A tier conveyor is vertically movable between drive-in and drive-out areas for receiving and discharging the vehicle at a selected level. The tier conveyor includes a transfer device having comb-like carrying arms. The transfer device includes a lifting device for transferring the vehicles to and from the parking device respectively. The parking devices are horizontally movable on parking rails arranged in the parking space and on travel rails arranged on the tier conveyor. The parking devices are pulled out of and pushed into the parking spaces or boxes by a hauling device which is arranged at the tier conveyor.

12 Claims, 6 Drawing Sheets

MULTI-TIER PARKING FACILITY SYSTEM FOR DEPOSITING AND REMOVING VEHICLES

FIELD OF THE INVENTION

The present invention is directed to a multi-tier or multi-level parking facility system for depositing and removing vehicles, particularly passenger automobiles.

BACKGROUND OF THE INVENTION

A multi-tier parking facility system for vehicles having a plurality of parking tiers arranged one above the other is known from U.S. Pat. No. 3,896,955. In such a parking facility system, the vehicles to be parked are first transported into the desired parking tier by a tier conveyor, upon whose platform is arranged a dispatching or distributing carriage which is movable on at least one travel rail. Before the distributing carriage moves via the travel rail into the parking tiers with a depositing or parking device for the vehicle, the paring tier likewise being provided with a parking rail, the vehicle located on the distributing carriage is lifted by a lifting fork having comb-like arms which support the wheels of the vehicles. After arriving in the desired parking space, the vehicle is lowered and, by this means, deposited on additional comb-like carrying arms arranged in the parking tier or space. The lifting fork is lowered again, the distributing carriage moves underneath the vehicle and moves the carrying arms out of the parking tier back onto the platform of the tier conveyor.

The heretofore known multi-tier parking facility system has proven disadvantages. More particularly, the distributing carriage for depositing and removal of vehicles increases the overall height of the parking tiers. This leads to an inefficient use of the enclosed space of the multi-tier parking facility system, especially taking into account the sum of individual heights of each of the parking tiers. Moreover, because of the rigid and cantilevering arrangement of the carrying arms, the steel construction defining the parking spaces and receiving the carrying arms must be constructed in a correspondingly stable manner in order to absorb the loading moment occurring due to the loading of the carrying arms.

OBJECT OF THE INVENTION

Therefore, the object of the present invention is to provide a multi-tier parking facility system having a compact construction and a minimal overall height of each of the parking tiers, particularly of the parking devices.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

SUMMARY OF THE INVENTION

According to one aspect of the present invention, a multi-tier parking device includes a hauling device for inserting and extracting a horizontally movable parking device. This arrangement makes it possible to minimize the overall height of the parking spaces or boxes due to the relocation or displacement of the drive to a transfer device for transferring of vehicles on the tier conveyor. In accordance with the present invention, the transfer device on the tier conveyor is advantageously achieved by arranging parking rails and travel rails for the parking devices in the center in the longitudinal direction of the tier conveyor and the parking spaces or boxes. This arrangement provides a uniform distribution of the load of the vehicle and the parking devices on the rails. In addition, the overall height of the parking devices is minimized as a result of arranging the parking devices with comb-like carrying arms, which are connected with one another via girders, as well as by the arrangement of rollers at the girders. These rollers are disposed between the girders as seen in the travel direction. The overall height of the parking spaces or boxes is further minimized by the particularly advantageous arrangement of the carrying arms disposed below the girders, which project out laterally over the parking rails, since the vehicles are accordingly lowered onto a lower level while exploiting the available ground clearance. As a result, only the vertical height region in the multi-tier parking facility system in which the travel rails are arranged is left open as useful surface areas for storing vehicles.

The parking device can be constructed at a much reduced weight than heretofore known. This results from the construction of the parking device having carrying arms which are arranged parallel to one another and at a predetermined distance from one another in the longitudinal direction. In this arrangement, two carrying arms are provided for receiving the front wheels of a vehicle and a plurality of carrying arms are provided for receiving the rear wheels thereof. Further, the wheels of the vehicles are securely held by the carrying arms, since they are pressed in between the carrying arms as explained below. Thus, it is unnecessary to engage the emergency brake of the parked vehicles. Expensive individual drives for the parking devices are also dispensed with, in that hook members are provided at the end of the parking device facing the tier conveyor utilized as points of application for the hauling device. Use of the hauling device makes it possible to also dispense with expensive limit switches for determining the end position of the parking devices due to the positive guidance of the parking device via the drivers. Moreover, since the parking rails and travel rails are arranged parallel to and at a predetermined distance from one another, the parking devices, although guided in the center, form a support for the vehicles which protects against tilting. The parking rails at the ends facing the tier conveyor and the travel rails at the ends facing the parking boxes are specially constructed as cut out portions in such a way that, on the one hand, the parking rails and travel rails complement one another when at the same vertical position while maintaining a gap and, on the other hand, overlap as seen in the travel direction of the parking devices. This ensures that the parking devices can safely traverse the joint between the parking rails and travel rails.

A particularly compact construction of the transfer device is provided in that the transfer device is constructed as a supporting frame which is guided vertically in the tier conveyor and driven by a lifting device and is provided with comb-like arms. A reliable transfer and take-over of the vehicles is ensured in that the carrying arms are arranged at the supporting frame in such a way that they are supplemented in a complementary manner with the arms of the parking device while maintaining a gap when the parking device is moved in and the transfer device is moved to the same level.

BRIEF DESCRIPTION OF THE DRAWING

The invention is explained in the following with reference to the drawings wherein like reference characters denote similar elements throughout the several views.

DETAILED DESCRIPTION OF THE PRESENTLY PREFERRED EMBODIMENTS

FIGS. 1*a* to 1*d* illustrate side views of sections of a multi-tier parking facility system according to the present invention. These figures depict various phases of a process for storing a motor vehicle. The storing process is explained in the following with reference to these figures.

Figure 1A:
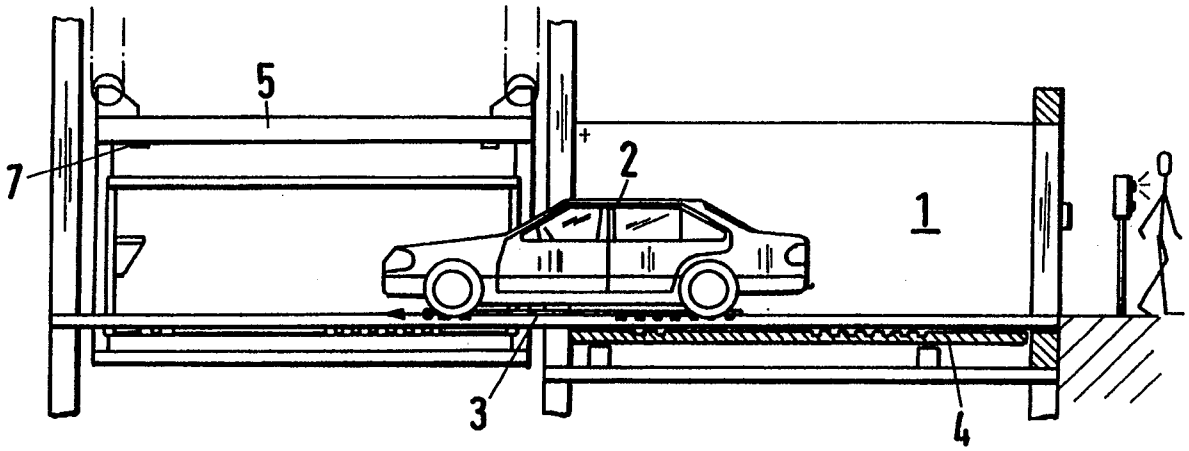
FIGS. 1*a* to 1*d* are side views of a cross section of a multi-tier parking facility system illustrating various phases of a process for storing a vehicle according to an embodiment of the invention.

FIG. 1*a* is a side view of the multi-tier parking facility system from the drive-in and drive-out area 1. As shown in that figure, a driver or user drives a vehicle 2 onto a parking device 3. After parking the vehicle 2 on the parking device 3, the user of the multi-tier parking facility exits the car and leaves the drive-in and drive-out area 1 via a platform 4. When the user has left the drive-in and drive-out area 1, the platform 4 enclosing the parking device 3 is then lowered and the vehicle 2 is received by the parking device 3. The vehicle is then moved horizontally by the parking device 3 into a tier conveyor 5. The platform 4 and the parking device 3 are driven by any suitable means.

Figure 1B:
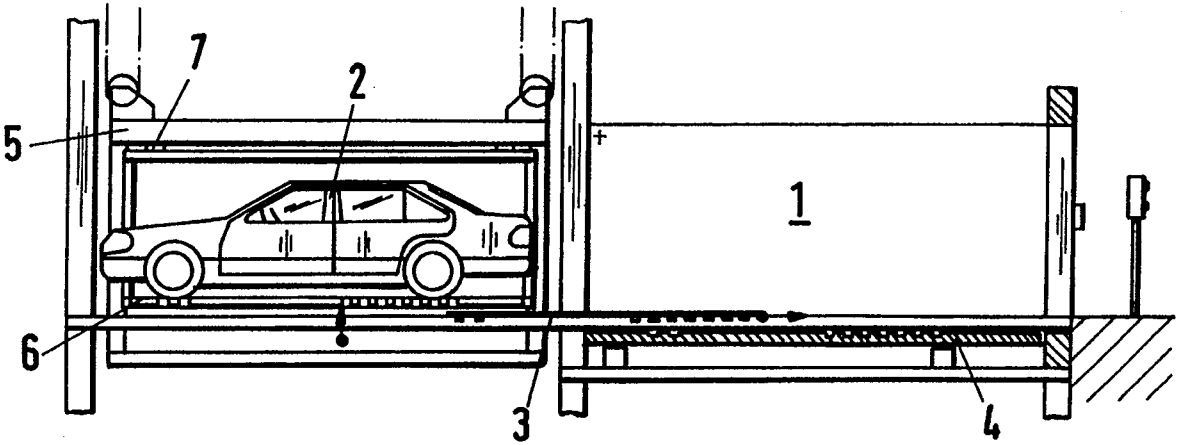

FIG. 1*b* shows that the tier conveyor 5 includes a transfer device 6 for transferring the vehicle 2 from the parking device 3 to the tier conveyor 5. The lifting device lowers the transfer device 6 below the level of the parking device 3. The parking device 3 is then horizontally moved onto the tier conveyor 5. The transfer device 6 can be raised or lowered relative to the tier conveyor 5 by a lifting device or means 7 arranged at the tier conveyor 5. The vehicle 2 is raised in the transfer device 6 by the lifting device 7. As a result, the vehicle is removed from the parking device 3, and the parking device 3, now vacant, is moved back into the drive-in area 1 so that additional vehicles may be received.

Figure 1C:
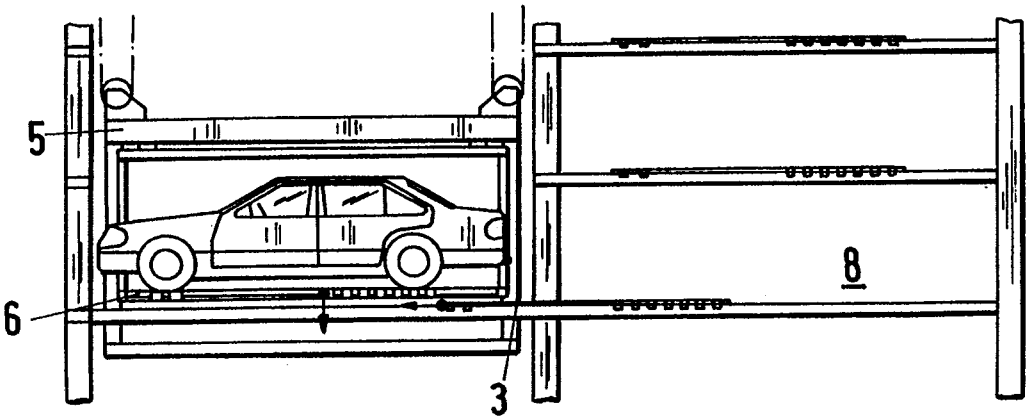

The tier conveyor 5, now carrying vehicle 2, is positioned adjacent an unoccupied parking space box or level 8. FIG. 1*c* shows the tier conveyor 5 in a locked holding position after being positioned adjacent the unoccupied parking level. The transfer device 6 is positioned somewhat above the space of the parking device 3 of the unoccupied parking space in the raised state. Following this, an unoccupied parking device 3 is moved out of a parking space 8 onto the tier conveyor 5 and positioned under the transfer device 6.

Figure 1D:
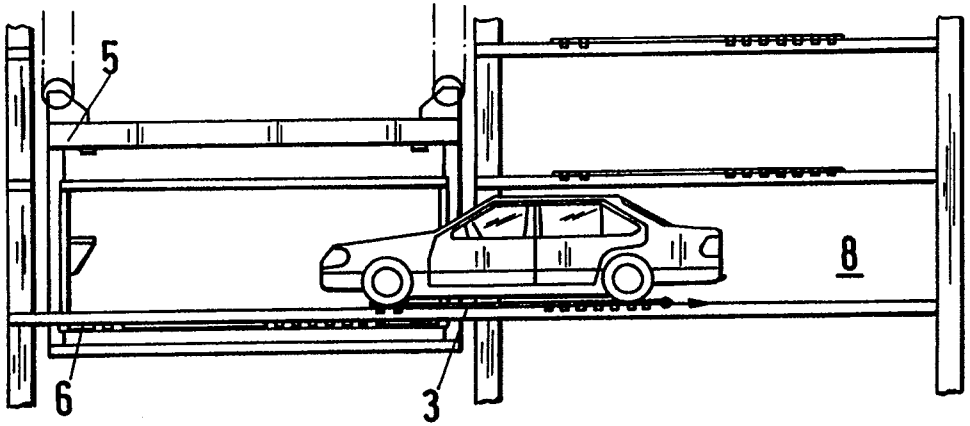

Referring to FIG. 1*d*, the transfer device 6 is next lowered to a level below the parking device 3. In this arrangement the vehicle 2 is now placed on the parking device 3. The parking device 3 along with the vehicle 2 are then moved into the parking space or box 8.

Figure 2:
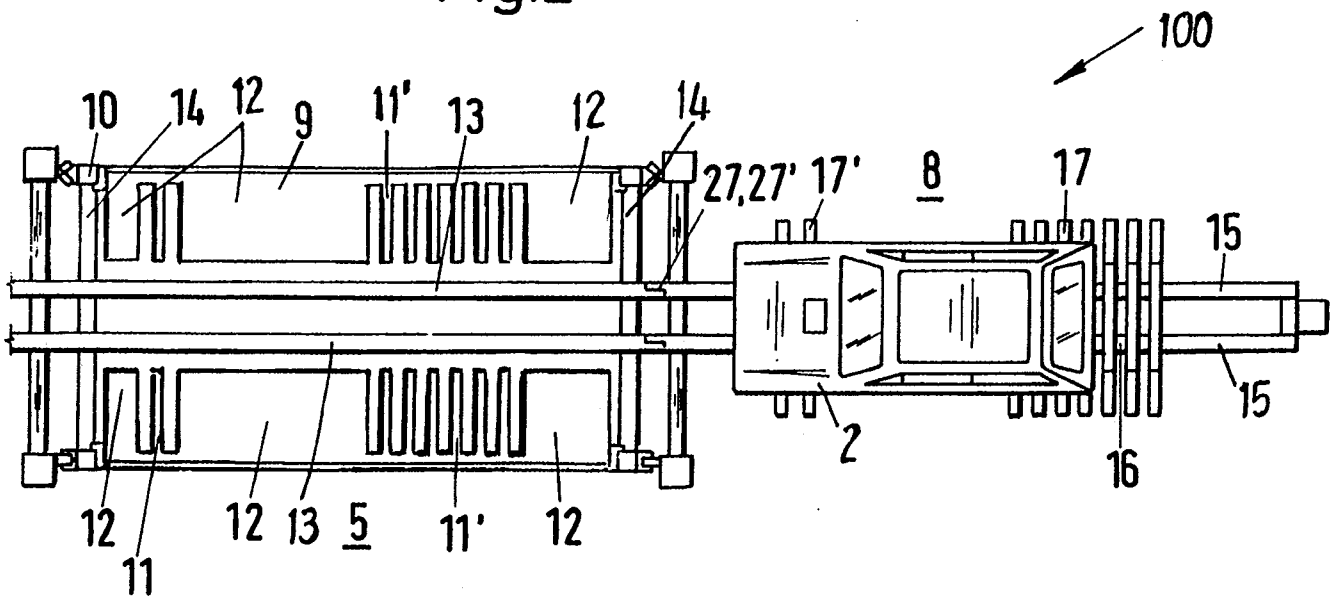
FIG. 2 is a top view of part of a parking tier.
Figure 3:
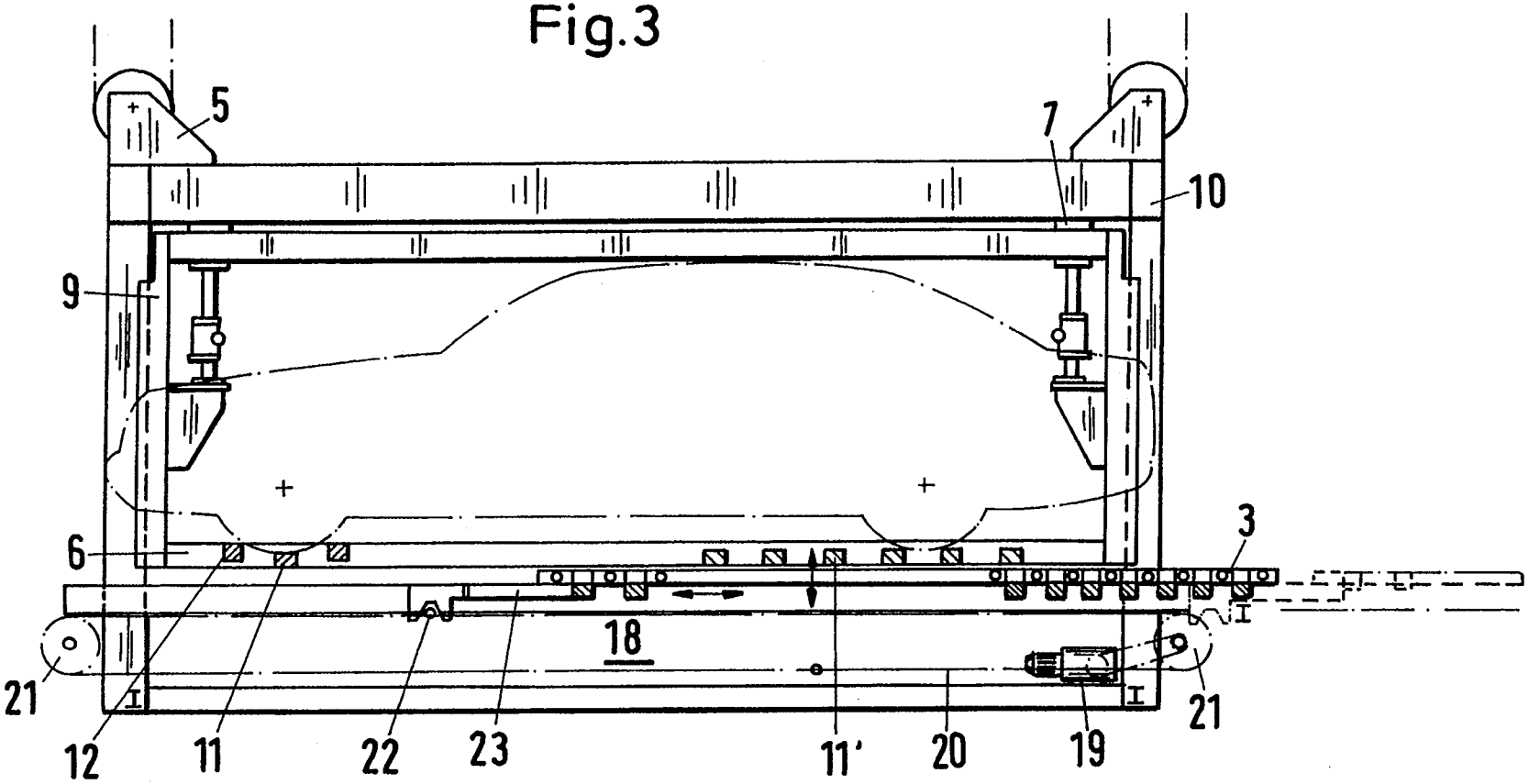
FIG. 3 is a side view of a tier conveyor with an adjoining parking device.

FIG. 2 shows a top view of part of a parking tier, generally referred to as 100, with the tier conveyor 5 adjacent a parking space 8. The transfer device 6 arranged on the tier conveyor 5 includes a rectangular supporting frame 9 which is guided vertically in its corner regions at a frame 10 of the tier conveyor 5. A plurality of carrying arms 11, 11' are arranged at the longitudinal sides of the supporting frame 9 for accommodating the wheels 31, 32 of the vehicle 2. The carrying arms 11, 11' of each longitudinal side are arranged at substantially right angles to the supporting frame 9 so as to be horizontal, parallel to and at a predetermined distance from one another so that they are oriented in the shape of teeth of a comb. More particularly, the carrying arms 11 are provided at each longitudinal side of the frame 9 for accommodating the front wheels 31 of the vehicle 2, and carrying arms 11' are provided for accommodating the rear wheels 32 of the vehicle 2. The intermediate spaces formed by the carrying arms 11 and the group of carrying arms 11' and by the supporting frame 9 are filled by support plates 12 which are arranged parallel to the carrying arms 11, 11' at a predetermined distance from the latter. The support plates 12 are arranged to be at a higher elevation than the carrying arms 11, 11' so that the front wheels 31, which rest on only one carrying arm 11, are supported in the front and back by the support plates 12 as seen in the travel direction of the parking device 3. As shown in FIG. 3, the centering of the front wheels 31 on the carrying arm 11 is effected by this arrangement. The support plates 12 also serve to define the parking surface for the rear wheels 32 on the carrying arms 11'. The length of the carrying arms 11, 11' is selected so that an intermediate space corresponding to approximately a third of the width of the supporting frame 9 remains between their free ends on opposite sides. This intermediate space is used for the arrangement of two travel rails 13 which extend parallel to one another in the longitudinal direction of the frame 10. The rails are arranged in their end region on crosspieces or transverse girders 14 fastened between the frame 10. The travel rails 13 project toward the front and rear, as seen in the longitudinal direction of the frame 10, beyond the frame 10 and transverse girders 14 and their ends are provided with cut out portions 27 in such a way that they engage with parking rails 15 arranged in the parking spaces boxes 8. Parking rails 15 are provided with complementary cut out portions 27'. A gap is present when cut out portions 27 are positioned juxtaposed to cut out portions 27'. The parking device 3 is horizontally movable on the travel rails 13 and parking rails 15.

The parking device 3 likewise has comb-like arms 17, 17' which are connected with an undercarriage 16. The undercarriage is moveable in forward and backward directions on the rails 13, 15 for moving the vehicle 2 to and from the tier conveyor 5. The comb-like construction of the arms 17, 17' of the parking device 3 and that of the carrying arms 11, 11' of the transfer device 6 mesh with each other so that a gap remains between the carrying arms 11, 11' and the arms 17, 17'. This arrangement enables them to slide through one another in the vertical direction.

FIG. 3 shows a side view of the tier conveyor 5 in a transferring position in front of an unoccupied parking space 8 with adjoining travel rails 15. The tier conveyor 5 includes the frame 10 which is suspended on hoisting cables 40 and in which the supporting frame 9 of the transfer device 6 is vertically guided. The supporting frame 9 of the transfer device 6 is shown in the raised position. Further, it can be seen that a hauling device 18 is arranged at the frame 10 for pulling and pushing the parking devices 3 out of and into a corresponding parking space 8. The hauling device 18 includes a gear motor 19 which is arranged at the frame 10 and drives a revolving traction mechanism 20. The traction mechanism 20 is guided by two deflecting rollers 21 which are arranged at the front and rear ends of the frame 10, as seen in the travel direction of the parking device 3, and are rotatable around horizontal axes 41. Drivers 22 are arranged at the traction mechanism 20 for engaging with a respective hook member 23 arranged at the parking device 3. The parking device 3 positioned in the parking space is shown in dashed lines.

Figure 4:
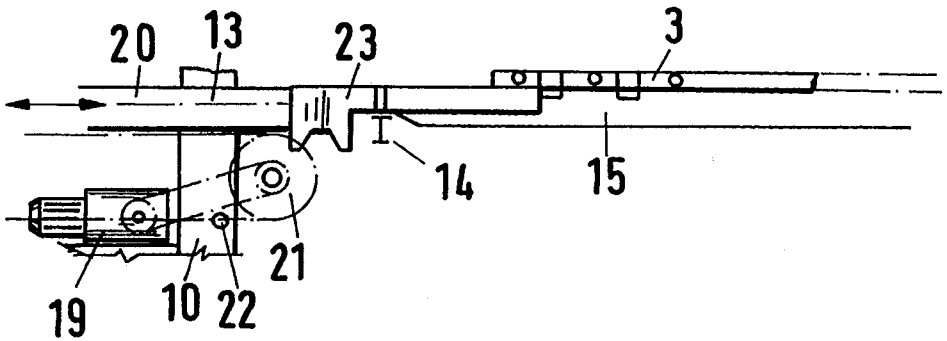
FIG. 4 shows an enlarged section from FIG. 3 of the region of the hauling drive.

FIG. 4 shows an enlarged section from FIG. 3 from the region of the gear motor 19 and a parking device 3. The gear motor 19 drives one of the deflecting rollers 21, which is rotatable around horizontal axes 41, via a traction mechanism constructed e.g. as a toothed belt 42, the revolving traction mechanism 20 being guided around this deflecting roller 21. The deflecting roller 21 is arranged outside the contour of the frame 10 and below the cut out portion 27 of the rail 13. In order to pull the parking device 3 out of the parking space 8, the gear motor 19 is set in motion and the driver 22 accordingly moves up from the lowest position, at the deflecting roller 21, which position is shown in the drawing, and engages in a hook member 23 arranged at the parking device 3 shortly before reaching the uppermost position. Since the driver 22, which is constructed preferably as a pin, now engages with the hook member 23, the parking device 3 is moved out of the parking box parallel to the traction mechanism 20 in the direction of the tier conveyor 5. Following a first driver 22, second and third drivers 22 engage in additional openings of the hook member 23 to ensure a reliable hauling connection. After reaching the second deflecting roller 21, the three drivers 22 are released from the hook member 23 one after the other and transported back into the region of the driven deflecting roller 21.

Figure 5:
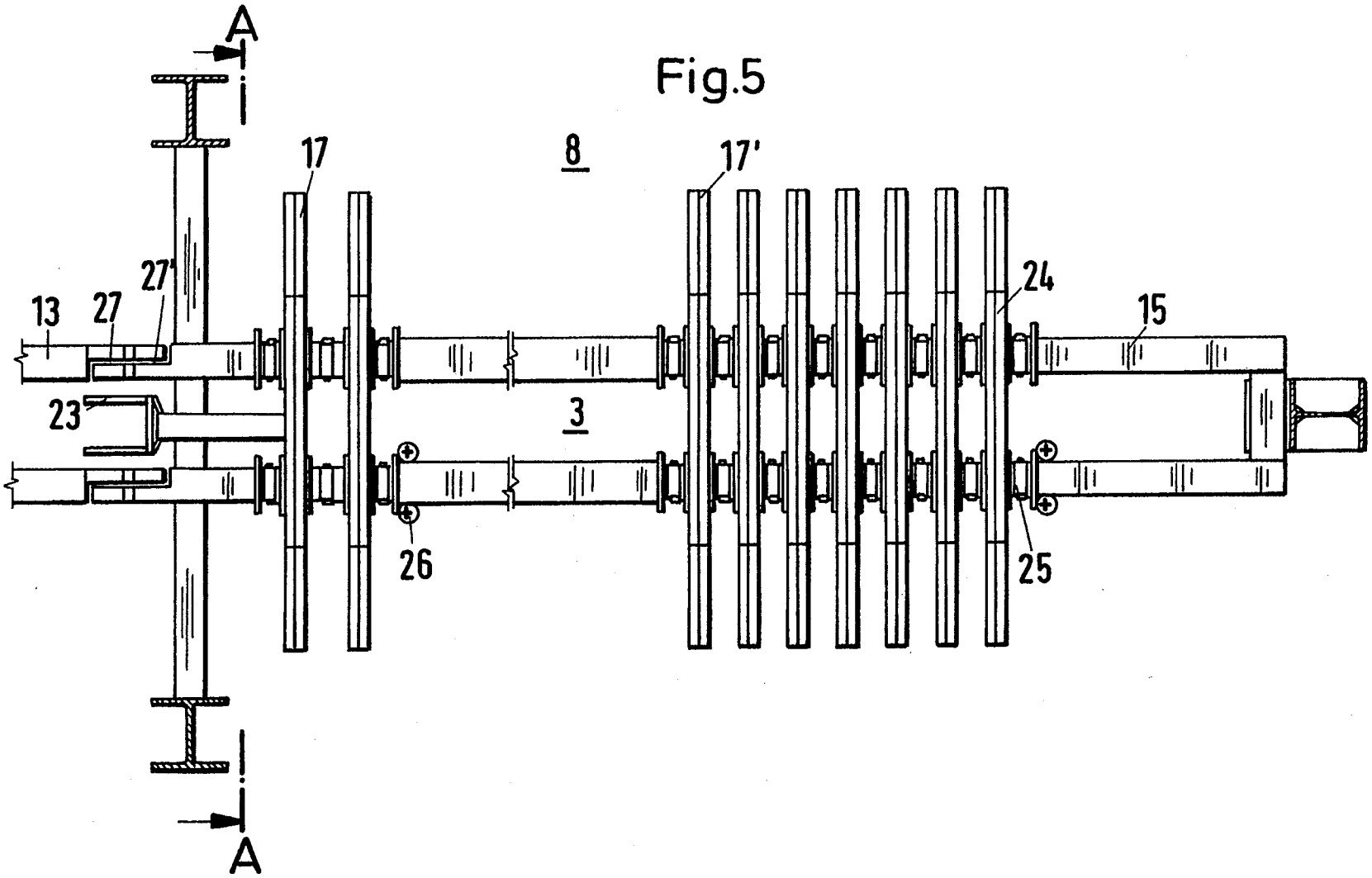
FIG. 5 is a top view of a parking device for motor vehicles.

FIG. 5 illustrates a top view of a parking space 8 with an unoccupied parking device 3 positioned thereto. The parking device 3 has a plurality of arms 17, 17′ which are arranged parallel to one another, two arms 17 being provided for receiving the front wheels 31 of the vehicles and a plurality of arms 17′ being provided for receiving the rear wheels 32 of the vehicles 2. The arms 17, 17′, which are arranged to the right and left of the parking rails 15, as seen in the travel direction, are connected with the undercarriage 16 of the parking device 3 via girders 24. The undercarriage 16 is formed by a plurality of rollers 25 which are arranged in front and in back of the arms 17, 17′, as seen in the travel direction of the parking device 3, and which roll on the surface of a travel rail 15 constructed as an I- or H-girder. In addition, the undercarriage 16 has lateral guide rollers 26 which guide the parking device 3 along the sides of the upper flange of the travel rail 15 constructed as an H-girder. Further, FIG. 5 shows the rectangular construction of the cut out portions 27, 27′ which enable an engagement of the travel rails 13 and parking rails 15. However, in this engagement position a gap remains between the rails 13, 15 and an overlapping of the parking rails 15 and travel rails 13 takes place in the travel direction.

Figure 6:
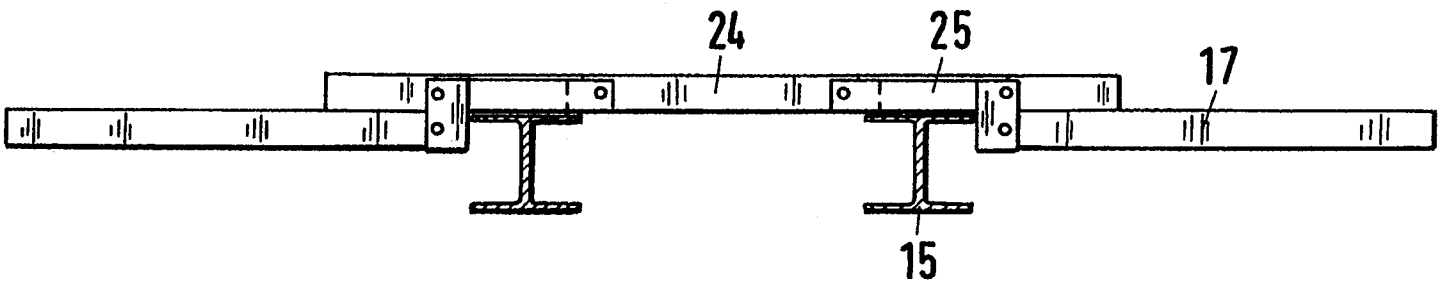
FIG. 6 shows an enlarged cross section A—A of FIG. 5.

FIG. 6 shows an enlarged cross section through FIG. 5 according to section line A—A. It can be seen that the arms 17, 17′ are arranged below the girder 24. The support height of the wheels of the vehicles 2 on the arms 17, 17′ is accordingly lowered somewhat to the level of the surface of the travel rails 15, the extent to which it is lowered being adapted to the average ground clearance of the vehicles. Further, the arms 17, 17′ do not project down beyond the lower flange of the travel rail 15 so as to infringe on the height of a parking box or space 8 located below it.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A multi-tier parking facility for depositing and removing at least one vehicle, said multi-tier parking facility comprising:

a drive-in and drive-out area for depositing and removing the vehicle;

a plurality of parking spaces arranged at a corresponding tier of said multi-tier parking facility, each of said parking spaces comprising a first parking rail and a parking device movable along said first parking rail, said parking device comprising a frame having a first plurality of carrying arms arranged therefrom in a comb-like shape for accommodating the vehicle; and a tier conveyor vertically movable for transporting the vehicle between the drive-in and drive-out area and a selected one of the plurality of parking spaces, said tier conveyor comprising (1) a transfer device having a second plurality of carrying arms for accommodating the vehicle, (2) a first travel rail, (3) a hauling device for providing a drive force to said parking device and (4) a lifting means for moving said transfer device in the vertical direction with respect to said tier conveyer;

wherein when said tier conveyor is positioned adjacent a selected parking space, said hauling device is engagable with said parking device to extract said parking device from said selected parking space such that said parking device is movable along said first parking rail and said first travel rail, and wherein said lifting means lifts said transfer device to transfer said vehicle to and from said parking device.

2. A multi-tier parking facility system according to claim 1, wherein said parking and travel rails are arranged in the center of the said tier conveyor and said parking space, respectively.

3. A multi-tier parking facility system according to claim 1, wherein said parking device further comprises a first girder operatively connected to said first plurality of carrying arms and a plurality of rollers connected to said parking device for guiding said parking device along said first parking rail and said first travel rail, wherein said first plurality of carrying arms are arranged on both sides of said parking rail.

4. A multi-tier parking facility system according to claim 3, wherein said parking device comprises a second plurality of girders, wherein said first plurality of carrying arms comprise first and second portions, wherein said second plurality of girders are arranged between said first and second portions, wherein said rollers are arranged between said second plurality of girders as seen in the travel direction and project out of the contour of said second plurality of girders in the direction of said first travel rail and said first parking rail.

5. A multi-tier parking facility system according to claim 4, wherein said first and second plurality of carrying arms are disposed below said first girder projecting laterally beyond said first travel and parking rails so that the supporting surface formed by said first and second carrying arms lies approximately on the level of the upper side of the said travel and parking rails.

6. A multi-tier parking facility system according to claim 5, wherein said first and second plurality of carrying arms are arranged parallel to one another and spaced apart by a predetermined distance from one another in the longitudinal direction of said parking device and wherein said second plurality of carrying arms comprise two arms for receiving front wheels of the vehicle and a remaining number of said second plurality of carrying arms is provided for receiving rear wheels of the vehicle.

7. A multi-tier parking facility system according to claim 1, wherein said parking device comprises a hook member arranged at an end of said parking device facing said tier conveyor and operatively engagable with said hauling device for extracting said parking device from said selected parking space.

8. A multi-tier parking facility system according to claim 1, further comprising a second travel rail and a second parking rail, wherein said first and second travel rails are separated by a predetermined distance and are arranged parallel to each other, and wherein said first and second parking rails are separated by a predetermined distance and are arranged parallel to each other.

9. A multi-tier parking facility system according to claim 8, wherein said first and second travel rails at ends facing said parking space and said first and second parking rails at ends facing said tier conveyor are each provided with a cut out portion so that said parking rails and said travel rails are arranged in a complementary manner in spaced relation with each other and wherein when said tier conveyor is positioned adjacent said selected parking space, said first parking rail and said first travel rail and said second parking rail and said second travel rail each overlap and form a corresponding gap as seen in the travel direction of the parking device.

10. A multi-tier parking facility system according to claim 9, wherein said transfer device comprises a supporting frame, wherein said second plurality of carrying arms are arranged in said supporting frame, and wherein said supporting frame is guided vertically in said tier conveyor by said lifting means.

11. A multi-tier parking facility according to claim 10, wherein said second plurality of carrying arms are arranged at said supporting frame so that said second plurality of carrying arms are intermeshable and in spaced relation with said first plurality of carrying arms when said lifting means lifts said frame to a level of said parking device.

12. A multi-tier parking facility system according to claim 1, wherein the vehicle comprises a passenger automobile.

* * * * *